US009746804B1

(12) United States Patent
Ichiki et al.

(10) Patent No.: US 9,746,804 B1
(45) Date of Patent: Aug. 29, 2017

(54) FIXING DEVICE AND IMAGE FORMING APPARATUS

(71) Applicant: FUJI XEROX CO., LTD., Tokyo (JP)

(72) Inventors: Yukihiro Ichiki, Kanagawa (JP); Motoyuki Yagi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/218,271

(22) Filed: Jul. 25, 2016

(30) Foreign Application Priority Data

Feb. 25, 2016 (JP) ..... 2016-034598

(51) Int. Cl.
*G03G 15/20* (2006.01)

(52) U.S. Cl.
CPC ..... *G03G 15/2053* (2013.01); *G03G 15/206* (2013.01); *G03G 2215/2009* (2013.01); *G03G 2215/2016* (2013.01); *G03G 2215/2029* (2013.01)

(58) Field of Classification Search
CPC ..... G03G 15/2017; G03G 15/206; G03G 15/2053; G03G 15/2064; G03G 2215/2009; G03G 2215/2016; G03G 2215/2022; G03G 2215/2025; G03G 2215/2029
USPC ..... 399/329; 219/216
See application file for complete search history.

(56) References Cited

U.S. PATENT DOCUMENTS 7,792,477 B2 * 9/2010 Nakamoto ..... G03G 15/2053 399/329
2010/0239337 A1 * 9/2010 Muramatsu ..... G03G 15/2064 399/329
2014/0294466 A1 10/2014 Matsuno

FOREIGN PATENT DOCUMENTS

JP 08202181 A * 8/1996
JP 2004-177533 A 6/2004
JP 2007079037 A * 3/2007
JP 2008076793 A * 4/2008
JP 2009003088 A * 1/2009
JP 2009020131 A * 1/2009
JP 2011-170051 A 9/2011
JP 2014-191302 A 10/2014

* cited by examiner

*Primary Examiner* — Robert Beatty
(74) *Attorney, Agent, or Firm* — Sughrue Mion, PLLC

(57) ABSTRACT

A fixing device includes a first belt that contacts a developer image on a recording medium; a second belt that sandwiches the recording medium with the first belt and hence forms a nip region extending in a transport direction of the recording medium; a rotational body that is provided inside the first belt in a region at a downstream side in the transport direction of the nip region, rotates, and turns the first belt; a pressing member that is provided inside the second belt and presses the second belt toward the rotational body; and a heating unit that is provided inside the first belt in a region at an upstream side in the transport direction of the nip region in a non-contact manner with respect to the first belt, and heats the developer image on the recording medium.

5 Claims, 4 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2016-034598 filed Feb. 25, 2016.

BACKGROUND

The present invention relates to a fixing device and an image forming apparatus.

SUMMARY

According to an aspect of the invention, there is provided a fixing device including a first belt that contacts a developer image on a recording medium; a second belt that sandwiches the recording medium with the first belt and hence forms a nip region extending in a transport direction of the recording medium; a rotational body that is provided inside the first belt in a region at a downstream side in the transport direction of the nip region, rotates, and turns the first belt; a pressing member that is provided inside the second belt and presses the second belt toward the rotational body; and a heating unit that is provided inside the first belt in a region at an upstream side in the transport direction of the nip region in a non-contact manner with respect to the first belt, and heats the developer image on the recording medium.

BRIEF DESCRIPTION OF THE DRAWINGS

An exemplary embodiment of the present invention will be described in detail based on the following figures, wherein.

DETAILED DESCRIPTION

Examples of a fixing device and an image forming apparatus according to this exemplary embodiment are described.

General Configuration

Figure 1:
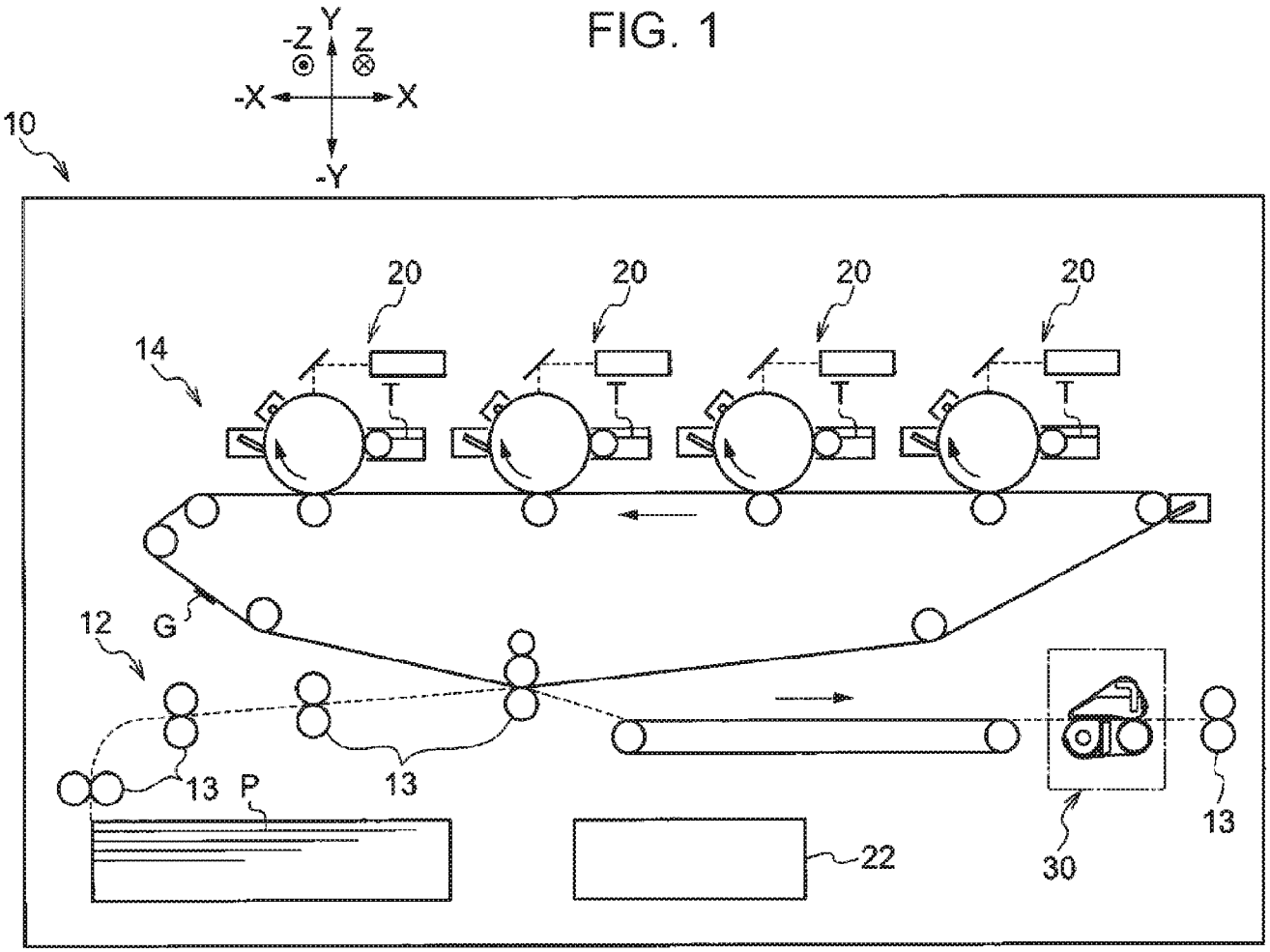
FIG. 1 is a configuration diagram showing an image forming apparatus according to this exemplary embodiment.

FIG. 1 shows an image forming apparatus 10 according to this exemplary embodiment. The image forming apparatus 10 includes a transport section 12 having roller pairs 13 that transport a sheet of paper P, an image forming section 14 that forms a toner image G on the sheet P transported by the transport section 12 by using a toner T, and a fixing device 30 that fixes the formed toner image G to the sheet P by heating and pressing the toner image G. The sheet P is an example of a recording medium. The toner T is an example of a developer. The toner image G is an example of a developer image. The image forming section 14 is an example of a developer image forming unit.

In the following description, it is assumed that a direction indicated by arrow Y in FIG. 1 represents an apparatus height direction, and a direction indicated by arrow X in FIG. 1 represents an apparatus width direction. Also, it is assumed that a direction (indicated by Z) orthogonal to the apparatus height direction and the apparatus width direction represents an apparatus depth direction. In front view of the image forming apparatus 10, the apparatus height direction, the apparatus width direction, and the apparatus depth direction are written as Y direction, X direction, and Z direction. Further, if one side and the other side of each of the X direction, Y direction, and Z direction are required to be distinguished from each other, in front view of the image forming apparatus 10, the upper side is written as Y side, the lower side is written as −Y side, the right side is written as X side, the left side is written as −X side, the deep side is written as Z side, and the near side is written as −Z side.

The image forming section 14 includes plural image forming units 20, and a controller 22 that controls operation of respective portions of the plural image forming units 20 and causes the image forming units 20 to form toner images G on a sheet P. Each of the image forming units 20 executes, for example, respective processes of charge with electricity, exposure to light, development, and transfer, which are included in a known electrophotographic system.

Major Section Configuration

The fixing device 30 is described next.

Figure 2:
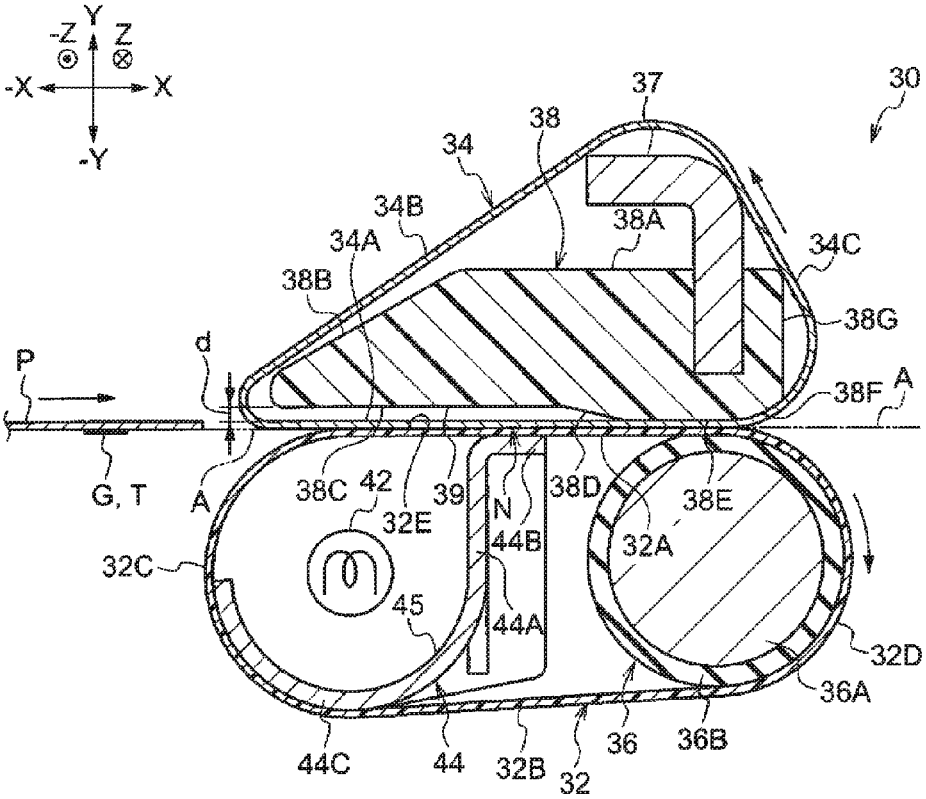
FIG. 2 is an explanatory view showing a fixing device according to this exemplary embodiment when viewed in the axial direction of a driving roller.

The fixing device 30 shown in FIG. 2 includes a fixing belt 32, a pressing belt 34, a driving roller 36, a pressing pad 38, and a halogen lamp 42. The fixing belt 32 is an example of a first belt. The pressing belt 34 is an example of a second belt. The driving roller 36 is an example of a rotational body. The pressing pad 38 is an example of a pressing member. The halogen lamp 42 is an example of a heating unit. In this exemplary embodiment, for example, the transport direction of a sheet P in the fixing device 30 is the X direction, and the width direction of the sheet P orthogonal to the X direction is the Z direction.

Fixing Belt

The fixing belt 32 is an endless belt. For example, the fixing belt 32 includes a base layer and a mold release layer covering the outer peripheral surface of the base layer. The material of the base layer may be a polymer, such as polyimide, polyamide, or polyimideamide; or a metal, such as stainless steel, nickel, or copper. In this exemplary embodiment, for example, polyimide is used. The mold release layer is made of, for example, tetrafluoroethylene-perfluoalkylvinylether copolymer (PFA). Also, the fixing belt 32 is arranged rotatably (turnably) around the axis, the axial direction of which is the Z direction, at the −Y side with respect to a transport path A of the sheet P.

Further, the driving roller 36, the halogen lamp 42, and a holder 44 serving as an example of a winding member are provided inside the fixing belt 32. In view in the Z direction of the fixing belt 32 at rest, the fixing belt 32 is divided into flat portions 32A and 32B, and arcuate portions 32C and 32D. The flat portions 32A and 32B are portions arranged linearly along the X direction and facing each other in the Y direction. The arcuate portions 32C and 32D are formed continuously from both end portions in the X direction of the flat portions 32A and 32B, and having semicircular arcuate shapes.

The flat portion 32A is located at the Y side with respect to the flat portion 32B. The arcuate portion 32D is located at the X side with respect to the arcuate portion 32C. Also, the fixing belt 32 sandwiches the sheet P with the pressing belt 34 and transports the sheet P in the X direction. Further, the fixing belt 32 is arranged so that the sheet P or the toner image G on the sheet P contacts an upper surface 32E which is a surface at the Y side of the flat portion 32A.

A non-contact temperature sensor (not shown) is provided on the outer peripheral surface of the fixing belt 32, at a position at which the temperature sensor faces an entry side portion of the sheet P. The temperature sensor measures the temperature of the fixing belt 32. The controller 22 (see FIG. 1) turns on the halogen lamp 42 if the temperature measured by the temperature sensor is lower than a preset fixing temperature, and turns off the halogen lamp 42 if the measured temperature is equal to or higher than the preset fixing temperature.

Pressing Belt

The pressing belt 34 is an endless belt. For example, the pressing belt 34 includes a base layer and a mold release layer covering the outer peripheral surface of the base layer. The material of the base layer may be a polymer, such as polyimide, polyamide, or polyimideamide; or a metal, such as stainless steel, nickel, or copper. In this exemplary embodiment, for example, polyimide is used. The mold release layer is made of, for example, PFA. Also, the pressing belt 34 is arranged rotatably (turnably) around the axis, the axial direction of which is the Z direction, at the Y side with respect to the transport path A of the sheet P.

The cross-sectional shape along an X-Y plane of the pressing belt 34 is, for example, a substantially triangular shape having three sides including a bottom side 34A along the transport path A and oblique sides 34B and 34C inclined in directions intersecting with the bottom side 34A, and including three arcuate (round) angles. Also, the pressing belt 34 plots a movement locus close to a triangle because of the rigidity against an external force acting toward the inside of the pressing belt 34. In this exemplary embodiment, for example, the shape of the pressing belt 34 is held so that the bottom angle at the downstream side of the pressing belt 34 in the transport direction of the sheet P is larger than the bottom angle at the upstream side. The pressing belt 34 sandwiches the sheet P with the fixing belt 32 and transports the sheet P.

In this case, a region where the outer peripheral surface of the fixing belt 32 and the outer peripheral surface of the pressing belt 34 sandwich the sheet P and the toner image G (the toner T) (a region where heating and pressing are provided), the region which extends in the transport direction of the sheet P, is called nip region N. That is, the fixing belt 32 and the pressing belt 34 form the nip region N. If the sheet P and the toner image G are not present, the fixing belt 32 contacts the pressing belt 34 in the nip region N. The nip region N is described later in detail.

Driving Roller

For example, the driving roller 36 has a configuration in which an elastic body layer 36B made of silicon rubber is formed on the outer peripheral surface of a cylindrical core metal 36A made of aluminum. The length in the Z direction of the driving roller 36 is larger than the width in the Z direction of the sheet P. Also, the driving roller 36 rotates around the Z direction as the axial direction, inside the fixing belt 32 in a region at the downstream side in the X direction of the nip region N. The driving roller 36 is rotated and stopped when the rotation of a motor (not shown) is controlled by the controller 22 (see FIG. 1).

Further, a portion of the outer peripheral surface of the driving roller 36 substantially entirely contacts the inner peripheral surface of the arcuate portion 32D of the fixing belt 32 to cause the fixing belt 32 to be turnable. In other words, the driving roller 36 rotates to turn the fixing belt 32 and to cause the pressing belt 34 to be moved (to turn).

Pressing Pad

For example, the pressing pad 38 is a long member made of polyethylene terephthalate (PET), being longer than the width of the sheet P in the Z direction, and provided inside the pressing belt 34. Also, a sheet metal 37 is fixed to the pressing pad 38. The sheet metal 37 has an L-shaped cross section in the Z direction and being elongated in the Z direction. Both end portions in the Z direction of the sheet metal 37 each are supported by a bracket (not shown). The bracket is driven by a retract mechanism portion (not shown) including a cam and a motor, and hence the pressing pad 38 is movable toward one of the Y side and the −Y side.

The state in which the pressing pad 38 is at the −Y side is a nip state in which the nip region N is formed. Also, the state in which the pressing pad 38 is at the Y side to eliminate a jam or the like of the sheet P is a nip release state. As described above, in the fixing device 30, the pressing pad 38 that is moved by the movement of the fixing belt 32 is retracted by the retract mechanism portion (not shown). Hence, as compared with a configuration in which the fixing belt 32 is retracted, displacement of the fixing belt 32 moved by the rotation of the driving roller 36 with respect to the transport path A of the fixing belt 32 is restricted.

In view in the Z direction of the pressing pad 38, the cross-sectional shape of the pressing pad 38 has an upper surface 38A, an inclined surface 38B, a lower surface 38C, an inclined surface 38D, a lower surface 38E, a curved surface 38F, and a side surface 38G successively in this order in the peripheral direction. Accordingly, the pressing pad 38 has a recess portion 39 formed such that a bottom portion at the −X side (the upstream side) is recessed toward the Y side as compared with a bottom portion at the X side (the downstream side). In other words, the recess portion 39 is a portion that is formed at the pressing pad 38, and is recessed toward the side (the Y side) opposite to the pressing belt 34, in a region at the upstream side in the transport direction of the sheet P (the upstream side of at least the center) of the nip region N.

The upper surface 38A is arranged along an X-Z plane. The inclined surface 38B is inclined so that a portion from the −X-side end of the upper surface 38A to the −Y-side end is located at the −X side with respect to the Y-side end. The lower surface 38C extends from the −Y-side end of the inclined surface 38B toward the X side along the X-Z plane. The inclined surface 38D is inclined so that a portion from the X-side end of the lower surface 38C to the −Y-side end is located at the X side with respect to the Y-side end. The lower surface 38E extends from the −Y-side end of the inclined surface 38D toward the X side along the X-Z plane.

The curved surface 38F is curved to protrude toward the transport path A from the X-side end of the lower surface 38E. The side surface 38G extends from the X-side end of the curved surface 38F to the X-side end of the upper surface 38A along a Y-Z plane. Respective boundary portions among the upper surface 38A, the inclined surface 38B, the lower surface 38C, the inclined surface 38D, the lower surface 38E, the curved surface 38F, and the side surface 38G have arcuate shapes (round shapes) in view in the Z direction.

The lower surface 38E and the curved surface 38F contact the inner peripheral surface of the pressing belt 34. The lower surface 38C faces the inner peripheral surface of the pressing belt 34 at a distance d in the Y direction. The distance d has, for example, a size close to the thickness in the Y direction of the sheet P. A portion in the X direction of the lower surface 38E presses the pressing belt 34 toward the driving roller 36 when the pressing pad 38 is moved to the −Y side by the retract mechanism portion (not shown).

Holder

The holder 44 is a member longer than the width of the sheet P in the Z direction, is made of a sheet metal, and is arranged inside the fixing belt 32. Also, the holder 44 is formed in a J shape, in which a vertical wall portion 44A, a flange portion 44B, and an arcuate portion 44C are integrated in the Z direction. The Y side of the holder 44 is open. The flange portion 44B is an example of a support portion.

The vertical wall portion 44A is a wall portion standing along the Y-Z plane. The vertical wall portion 44A is located inside the fixing belt 32, at the −X side with respect to the center in the X direction. The flange portion 44B is a plate-shaped portion overhanging from the Y-side end portion of the vertical wall portion 44A toward the X side along the X-Z plane. The arcuate portion 44C is a portion formed in a semicircular arcuate shape extending from the −Y-side end portion of the vertical wall portion 44A toward the −X side and protruding downward. Also, a reflecting surface 45 being a mirror is formed on the surface at the inside in the radial direction (being the inner peripheral surface and the surface at the Y side) of the arcuate portion 44C and the side surface at the −X side of the vertical wall portion 44A. That is, the holder 44 includes the reflecting surface 45.

The upper surface (the surface at the Y side) of the flange portion 44B contacts the lower surface of the flat portion 32A of the fixing belt 32. To be specific, the flange portion 44B supports the fixing belt 32 from the −Y side at a position located downstream of the halogen lamp 42 (described later) and upstream of the driving roller 36 in the transport direction of the sheet P. Also, a portion of the arcuate portion 32C of the fixing belt 32 is wound around a portion of the outer peripheral surface of the arcuate portion 44C in a range corresponding to a quarter circle at the −X side.

Halogen Lamp

The halogen lamp 42 is provided at a position corresponding to the center of the arc of the arcuate portion 44C to have the longitudinal direction in the Z direction. A light emitting portion of the halogen lamp 42 has a length in the Z direction being substantially the same as the length in the Z direction of the sheet P. To be specific, the halogen lamp 42 is provided inside the fixing belt 32 in a region at the upstream side in the X direction of the nip region N (described later) in a non-contact manner with respect to the fixing belt 32.

The halogen lamp 42 is turned on when energized from a power supply (not shown), heats a portion of the fixing belt 32 at the upstream side (the −X side) of the nip region N, and hence indirectly heats the toner image G on the sheet P through the fixing belt 32. The reflecting surface 45 reflects the light of the halogen lamp 42 toward a region at the upstream side in the X direction of the nip region N.

The nip region N is described next.

Figure 3:
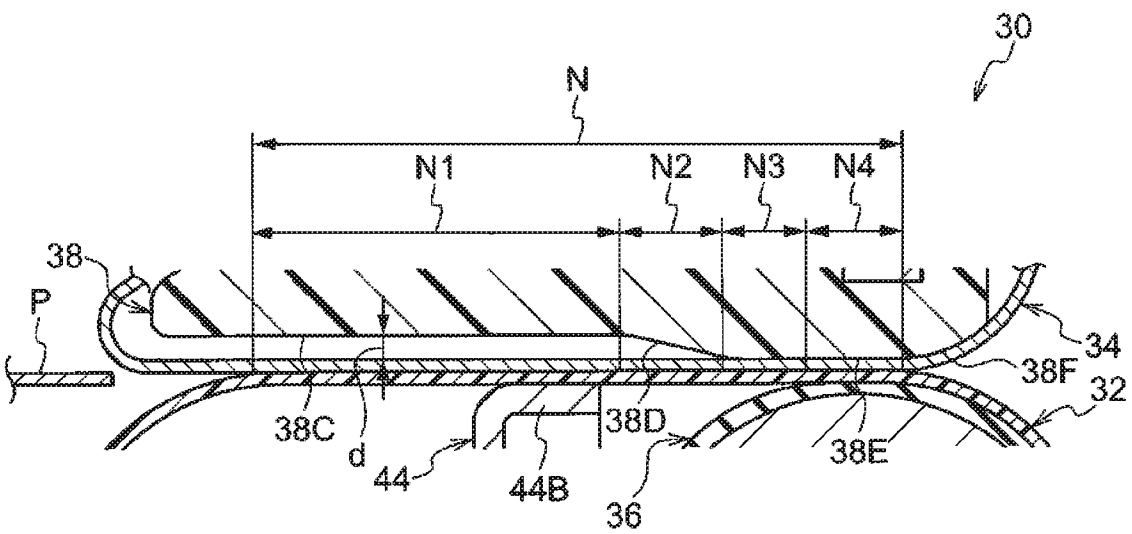
FIG. 3 is an explanatory view showing a nip region of the fixing device according to this exemplary embodiment.

As shown in FIG. 3, for example, the nip region N is divided into a first region N1, a second region N2, a third region N3, and a fourth region N4, from the upstream side (the −X side) toward the downstream side (the X side) in the X direction. The region where the first region N1 is located in the X direction is an example of a region at an upstream side. The region where the fourth region N4 is located in the X direction is an example of a region at a downstream side.

The first region N1 is a region that faces the lower surface 38C of the pressing pad 38 in the Y direction. In a portion of the first region N1, the fixing belt 32 contacts the flange portion 44B. Also, in the first region N1, the pressing belt 34 is separated from the pressing pad 38 by the distance d when the sheet P (see FIG. 2) does not enter the first region N1.

The second region N2 is a region arranged next to the inclined surface 38D of the pressing pad 38 in the Y direction. Also, in the second region N2, the pressing belt 34 is separated from the pressing pad 38 by a distance equal to or smaller than the distance d in a wedge shape when the sheet P (see FIG. 2) does not enter the second region N2.

The third region N3 is a region arranged next to the lower surface 38E of the pressing pad 38 in the Y direction. In the third region N3, the lower surface 38E contacts the pressing belt 34, and the fixing belt 32 is not supported by the driving roller 36. Also, in the third region N3, the fixing belt 32 contacts the pressing belt 34 when the sheet P (see FIG. 2) does not enter the third region N3.

The fourth region N4 is a region arranged next to the lower surface 38E of the pressing pad 38 in the Y direction. In the fourth region N4, the lower surface 38E contacts the pressing belt 34, and the fixing belt 32 is supported by the driving roller 36. Also, in the fourth region N4, the fixing belt 32 contacts the pressing belt 34 when the sheet P (see FIG. 2) does not enter the fourth region N4.

In this case, since the first region N1 has the recess portion 39 as described above, the pressing belt 34 is separated from the pressing pad 38 by the distance d. Hence, the pressing force acting on the sheet P when the sheet P enters the first region N1 is smaller than the pressing force acting on the sheet P when the sheet P enters the second region N2, the third region N3, and the fourth region N4. That is, the first region N1 is a region with the smallest pressing force acting on the sheet P and the toner image G (see FIG. 2) in the nip region N.

In the second region N2, the pressing belt 34 is separated from the pressing pad 38 by the distance equal to or smaller than the distance d in a wedge shape. Hence, the pressing force acting on the sheet P when the sheet P enters the second region N2 is larger than the pressing force acting on the sheet P when the sheet P enters the first region N1, and is smaller than the pressing force acting on the sheet P when the sheet P enters the third region N3 and the fourth region N4.

In the third region N3, the pressing pad 38 contacts the pressing belt 34, and the fixing belt 32 is not supported by the driving roller 36. Hence, the pressing force acting on the sheet P when the sheet P enters the third region N3 is larger than the pressing force acting on the sheet P when the sheet P enters the second region N2, and is smaller than the pressing force acting on the sheet P when the sheet P enters the fourth region N4.

In the fourth region N4, the pressing pad 38 contacts the pressing belt 34, and the fixing belt 32 is supported by the driving roller 36. Hence, the pressing force acting on the sheet P when the sheet P enters the fourth region N4 is larger than the pressing force acting on the sheet P when the sheet P enters the third region N3. As described above, in the nip region N, the pressing force acting on the sheet P increases sequentially from the first region N1 to the fourth region N4.

Operation

Operation according to this exemplary embodiment is described next.

In the image forming apparatus 10 shown in FIG. 1, rising operation of the fixing device 30 is started in synchronization with formation of a toner image G on a sheet P by the image forming section 14. To be specific, in the fixing device 30 shown in FIG. 2, the halogen lamp 42 is turned on, and the driving roller 36 starts rotating. By the rotation of the driving roller 36, the fixing belt 32 starts turning and the pressing belt 34 being in contact with the fixing belt 32 is moved by the fixing belt 32.

Among the light emitted from the halogen lamp 42, light directed toward the Y side and the −X side with respect to the halogen lamp 42 reaches the fixing belt 32, is absorbed by the fixing belt 32, and increases the temperature of the fixing belt 32. Among the light emitted from the halogen lamp 42, light directed toward the −Y side and the X side with respect to the halogen lamp 42 is reflected by the reflecting surface 45 toward the Y side and the −X side, is absorbed by the fixing belt 32, and increases the temperature of the fixing belt 32.

Figure 4A:
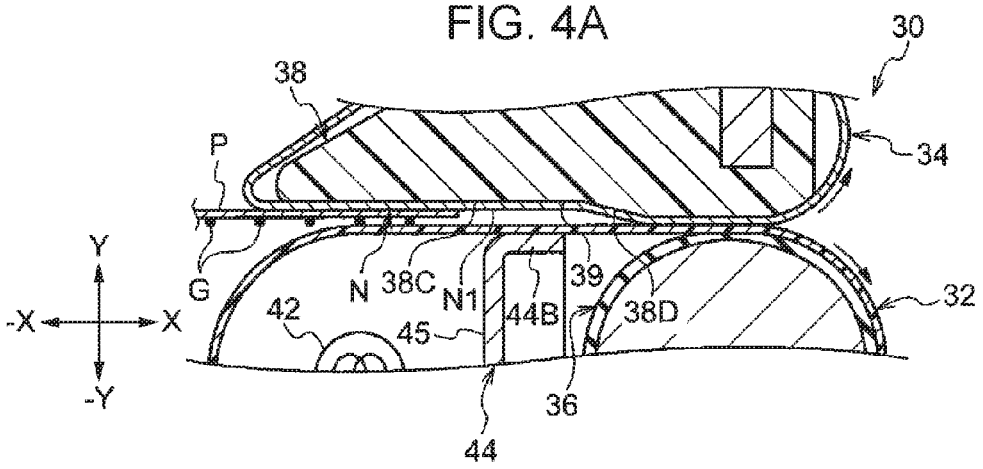
FIGS. 4A, 4B, and 4C are explanatory views showing states of fixing a toner image on a transported sheet transported in the fixing device according to this exemplary embodiment.

As shown in FIG. 4A, when the sheet P with the toner image G formed thereon enters the first region N1, the sheet P tends to push and separate the fixing belt 32 and the pressing belt 34 in the Y direction. In this case, the fixing belt 32 is supported by the flange portion 44B from the −Y side. Hence, in the fixing device 30, a warp of the fixing belt 32 toward the −Y side in the nip region N is restricted as compared with a configuration without the flange portion 44B. In particular, a portion of the fixing belt 32 located downstream of the halogen lamp 42 and located upstream of the driving roller 36 is near the center of the nip region N, and the warp of the portion toward the −Y side may be increased as compared with the other portion. However, since the portion is supported by the flange portion 44B, the warp is restricted.

In contrast, since the pressing belt 34 is not supported by the pressing pad 38 from the Y side, the pressing belt 34 is deformed toward the recess portion 39, and contacts the lower surface 38C and the inclined surface 38D of the pressing pad 38. This state is a state in which the pressing force acting on the sheet P is the smallest. That is, in the fixing device 30, the pressing force acting on the sheet P in the nip region N is decreased as compared with a configuration in which the recess portion 39 is not formed at the pressing pad 38. In other words, in the fixing device 30, the nip region N elongated in the transport direction may be ensured while the pressing force acting on the sheet P is minimized in the nip region N. Then, the sheet P is transported toward the X side. Also, the toner image G is heated and molten by the halogen lamp 42 and the fixing belt 32.

Figure 4B:
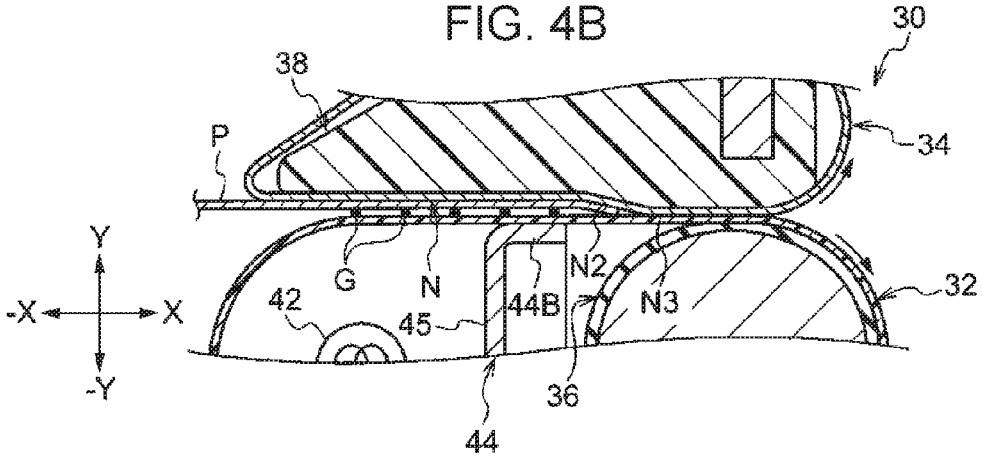

As shown in FIG. 4B, when the sheet P enters the second region N2 and is transported, the gap between the fixing belt 32 and the pressing belt 34 gradually decreases, and the pressing force acting on the sheet P gradually increases. When the sheet P enters the third region N3, the pressing force larger than the pressing force in the second region N2 acts on the toner image G.

Figure 4C:
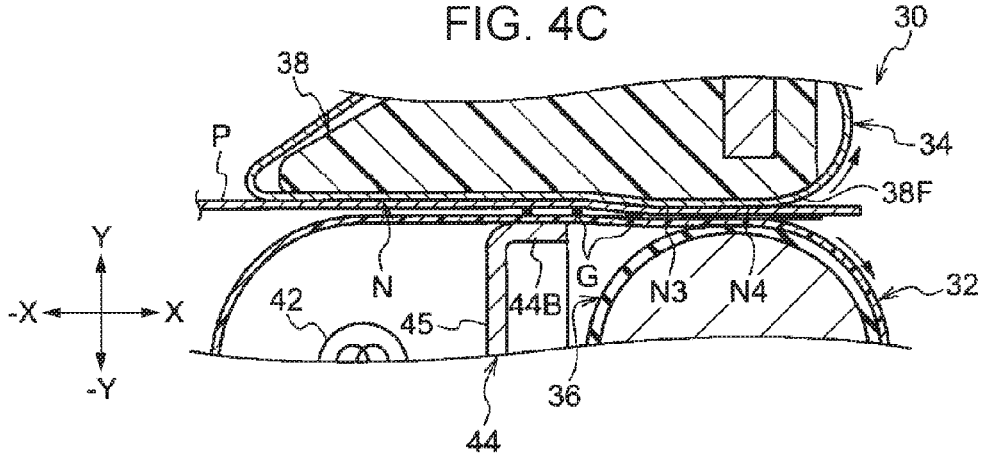

As shown in FIG. 4C, when the sheet P enters the fourth region N4, the pressing force larger than the pressing force in the third region N3 (the largest pressing force in the nip region N) acts on the toner image G. The leading edge portion of the sheet P moving out toward the X side from the fourth region N4 is separated from the pressing belt 34 when the pressing belt 34 moves along the shape of the curved portion 38F. In this way, the toner image G is heated and pressed in the nip region N, and is fixed to the sheet P.

It is assumed that a fixing device according to a comparative example forms a nip region with a pair of belts and presses a recording medium at plural positions in a transport direction of a sheet P in the nip region. When the fixing device 30 according to this exemplary embodiment is compared with the fixing device according to the comparative example, the fixing device 30 according to this exemplary embodiment has a smaller number of portions at which the sheet P is pressed. Hence, the length in the X direction of the pressing region of the sheet P in the nip region N is smaller than that of the fixing device according to the comparative example. Accordingly, in the fixing device 30, an excessive pressing force does not act on the sheet P as compared with the comparative example, and hence a wrinkle of the sheet P is restricted.

In the fixing device 30, since the nip region N extending in the X direction is formed, the fixing temperature allowed to be set is lower than that of a fixing device in which a narrow nip region is formed by a pair of rollers. Hence, the rising time until the start of fixing is decreased.

Also, in the fixing device 30, since the light of the halogen lamp 42 is reflected by the reflecting surface 45, the light of the halogen lamp 42 is collected at the upstream side of the nip region N. That is, the toner image G is heated with not only the light directly emitted on the fixing belt 32 from the halogen lamp 42, but also the light reflected by the reflecting surface 45. Accordingly, heating efficiency of the toner image G is increased as compared with a configuration without the reflecting surface 45. The heating efficiency is the ratio of the energy amount to be supplied to the toner image G with respect to the total energy amount of the light emitted from the halogen lamp 42.

Further, in the fixing device 30, the portion of the fixing belt 32 is wound around the holder 44. Accordingly, deformation (variation) in the cross-sectional shape being elongated in the X direction of the fixing belt 32 is restricted as compared with a configuration in which only the halogen lamp 42 is provided inside the fixing belt 32 in the region at the upstream side in the nip region N. The restriction of deformation in the cross-sectional shape in the X direction of the fixing belt 32 represents restriction of displacement of the sheet P transported by the movement of the fixing belt 32. That is, in the fixing device 30, the transport state of the sheet P is stable as compared with a configuration without the holder 44.

With the image forming apparatus 10 shown in FIG. 1, in the fixing device 30, a wrinkle of the sheet P is restricted as compared with the configuration of the above-described comparative example. Accordingly, misregistration of the toner image G on the sheet P is restricted, and hence image defect of the toner image G in the image forming apparatus 10 is restricted as compared with a configuration without the fixing device 30.

The present invention is not limited to the above-described exemplary embodiment.

In the fixing device 30, the halogen lamp 42 and the driving roller 36 may be arranged inside the fixing belt 32, and the holder 44 may be omitted. That is, the shape of the fixing belt 32 may be held because of the rigidity of the fixing belt 32 against an external force acting toward the inside of the fixing belt 32. Also, the holder 44 and the reflecting surface 45 may be separate members. Further, the fixing belt 32 and the pressing belt 34 may be made of different materials or may have different layers.

In the fixing device 30, instead of the halogen lamp 42, a heat generating layer that generates heat by an effect of a magnetic field may be provided at the fixing belt 32, a magnetic-field generating unit, which does not contact the fixing belt 32, may be provided inside the fixing belt 32, and the fixing belt 32 may be heated by an electromagnetic induction effect. Also, the fixing belt 32 may be formed of a transparent resin belt, a laser light source, and an optical member that condenses laser light of the laser light source at a portion of the nip region N may be provided inside the fixing belt 32, and hence the fixing belt 32 may be heated.

The inclined surface 38D may be omitted, and the first region N1 and the second region N2 may be formed of a single first region N1. Also, the third region N3 may be omitted, and the third region N3 and the fourth region N4 may be formed of a single fourth region N4.

A felt containing oil may be provided at a flat portion of the sheet metal 37 along the X-Z plane, oil may be applied to the inner peripheral surface of the pressing belt 34, and hence a frictional resistance due to contact between the pressing belt 34 and the pressing pad 38 may be decreased.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a first belt configured to contact a developer image on a recording medium;

a second belt configured to sandwich the recording medium with the first belt and hence form a nip region extending in a transport direction of the recording medium;

a rotational body that is provided inside the first belt in a region at a downstream side in the transport direction of the nip region, wherein the rotational body is configured to rotate and turn the first belt;

a pressing member that is provided inside the second belt, wherein the pressing member is configured to press the second belt toward the rotational body; and a heating unit that is provided inside the first belt in a region at an upstream side in the transport direction of the nip region in a non-contact manner with respect to the first belt, wherein the heating unit is configured to heat the developer image on the recording medium, and wherein the pressing member has a recess portion that is recessed to a side opposite to the second belt in the region at the upstream side in the transport direction of the nip region.

2. The fixing device according to claim 1, wherein the heating unit has a halogen lamp and a reflecting surface configured to reflect light of the halogen lamp toward the nip region.

3. The fixing device according to claim 2, further comprising a winding member including the reflecting surface, a portion of the first belt being wound around the winding member.

4. An image forming apparatus comprising:

a developer image forming unit configured to form a developer image on a recording medium; and the fixing device according to claim 1 configured to fix the developer image on the recording medium formed by the developer image forming unit, to the recording medium.

5. A fixing device comprising:

a first belt configured to contact a developer image on a recording medium;

a second belt configured to sandwich the recording medium with the first belt and hence form a nip region extending in a transport direction of the recording medium;

a rotational body that is provided inside the first belt in a region at a downstream side in the transport direction of the nip region, wherein the rotational body is configured to rotate and turn the first belt;

a pressing member that is provided inside the second belt, wherein the pressing member is configured to press the second belt toward the rotational body; and a heating unit that is provided inside the first belt in a region at an upstream side in the transport direction of the nip region in a non-contact manner with respect to the first belt, wherein the heating unit is configured to heat the developer image on the recording medium, wherein the heating unit has a halogen lamp and a reflecting surface configured to reflect light of the halogen lamp toward the nip region, wherein the fixing device further comprises a winding member including the reflecting surface, a portion of the first belt being wound around the winding member, and wherein the winding member includes a support portion that supports the first belt at a position located downstream of the heating unit and located upstream of the rotational body in the transport direction.

* * * * *